US008475077B2

(12) United States Patent
Howell

(10) Patent No.: US 8,475,077 B2
(45) Date of Patent: Jul. 2, 2013

(54) NONLETHAL BARRIER

(71) Applicant: Terry Howell, Tipp City, OH (US)

(72) Inventor: Terry Howell, Tipp City, OH (US)

( * ) Notice: Subject to any disclaimer, the term of this patent is extended or adjusted under 35 U.S.C. 154(b) by 0 days.

(21) Appl. No.: 13/690,194

(22) Filed: Nov. 30, 2012

(65) Prior Publication Data

US 2013/0142570 A1 Jun. 6, 2013

Related U.S. Application Data

(60) Provisional application No. 61/566,335, filed on Dec. 2, 2011.

(51) Int. Cl.
*E01F 13/04* (2006.01)

(52) U.S. Cl.
USPC ..... 404/6; 404/10; 49/9; 49/34; 49/49; 188/371

(58) Field of Classification Search
USPC . 49/9, 34, 49; 404/6, 10; 188/371; 244/110 C
See application file for complete search history.

(56) References Cited

U.S. PATENT DOCUMENTS

| | | | | |
|---|---|---|---|---|
| 2,237,106 | A * | 4/1941 | Minert | 49/9 |
| 3,659,811 | A * | 5/1972 | Borehag | 244/110 C |
| 3,695,559 | A * | 10/1972 | Cruger et al. | 244/110 C |
| 5,829,912 | A * | 11/1998 | Marcotullio et al. | 404/6 |
| 5,993,104 | A | 11/1999 | Marcotullio et al. | |
| 6,192,627 | B1 * | 2/2001 | Gompertz et al. | 49/34 |
| 6,312,188 | B1 * | 11/2001 | Ousterhout et al. | 404/6 |
| 6,896,443 | B1 * | 5/2005 | Ousterhout et al. | 404/6 |
| 7,195,419 | B2 * | 3/2007 | Gelfand | 404/6 |
| 7,210,873 | B2 * | 5/2007 | Gelfand | 404/6 |
| 7,377,716 | B2 * | 5/2008 | Gelfand | 404/6 |
| 7,467,909 | B2 | 12/2008 | Orner, Jr. et al. | |
| 7,824,126 | B2 * | 11/2010 | Costa | 404/6 |
| 8,240,947 | B2 * | 8/2012 | Gelfand et al. | 404/6 |
| 2010/0202829 | A1 | 8/2010 | Gelfand et al. | |

OTHER PUBLICATIONS

General Dynamics, "Portable Vehicle Arresting Barrier (PVAB)", General Dynamics Ordnance and Tactical Systems, retrieved from http://www.gd-ots.com/PVAB.html, downloaded on Nov. 30, 2012.
FutureNet Group, Inc., FutureNet Security Solutions, "EMB™", Expeditionary Mobile Barrier (EMB) Mobile Net Barrier -Smith & Wesson Security Solutions, retrieved from http://futurenetsecurity.com/products/mobile-barriers/emb/, downloaded on Nov. 30, 2012.

* cited by examiner

*Primary Examiner* — Gary Hartmann
(74) *Attorney, Agent, or Firm* — Thomas E. Lees, LLC

(57) ABSTRACT

A nonlethal barrier system includes a first base having a frame, a shaft and a brake. The brake includes a stationary magnet physically coupled to the frame such that the shaft passes through the stationary magnet. Further, the brake includes an adjustable magnet that creates a magnetic field with the stationary magnet, where the strength of the magnetic field is alterable by rotating the adjustable magnet. A slab physically coupled to the shaft is disposed in the magnetic field. A net is furled around the shaft of the first base such that when an external force is applied to the net, the shaft of the first base rotates and unfurls at least a portion of the net. The slab applies a resistance, based on the strength of the magnetic field, to the shaft of the first base to control the rate at which the net unfurls from the shaft.

17 Claims, 7 Drawing Sheets

NONLETHAL BARRIER

CROSS REFERENCE TO RELATED APPLICATIONS

This application claims the benefit of U.S. Provisional Patent Application Ser. No. 61/566,335 entitled "NON LETHAL BARRIER" by Terry Howell filed Dec. 2, 2011, the disclosure of which is hereby incorporated by reference in its entirety.

BACKGROUND

Various aspects of the present disclosure relate generally to barriers for immobilizing a vehicle and more specifically to barriers that are capable of decelerating a vehicle to a stop over a distance that provides non-lethal vehicle restraint.

At times a responder, such as law enforcement or military personnel, is required to stop a moving vehicle. For example, a person driving a vehicle may lose control over the vehicle for medical reasons (e.g., heart attack, narcolepsy, seizure, etc.). In this instance, the goal of the responder is to stop the vehicle without the incapacitated vehicle operator becoming a casualty of the vehicle immobilization process so that proper medical treatment can be administered. As another example, a vehicle may experience a mechanical malfunction that renders the vehicle uncontrollable. Again, the goal of the responder is to stop the vehicle without causing the helpless vehicle operator to become a casualty of the vehicle immobilization process.

Still further, the responder may be required to stop a vehicle operated by a reckless operator, an operator fleeing from a crime or a person operating a vehicle for other nefarious purposes. Here, the goal of the responder is to intervene in the activities of the vehicle operator by immobilizing the vehicle without using lethal force. In yet another example, a vehicle laden with explosives heading toward a military base should be stopped before that vehicle reaches the base. However, the military may wish to utilize a barrier that immobilizes the vehicle using a nonlethal force that allows an opportunity to capture and detain any vehicle occupants.

BRIEF SUMMARY

According to various aspects of the present disclosure, a nonlethal barrier system is disclosed. The nonlethal barrier system comprises: a first base comprising a frame, a shaft rotatably coupled to the frame, and a first brake. The first brake includes a stationary magnet physically coupled to the frame, and the shaft passes through the stationary magnet. Further, the first brake includes an adjustable magnet magnetically coupled to the stationary magnet to create a magnetic field between the stationary magnet and the adjustable magnet such that the strength of the magnetic field is alterable by rotating the adjustable magnet. Also, the first brake includes a slab physically coupled to the shaft, wherein the slab is disposed in the magnetic field between the stationary magnet and the adjustable magnet. A net is furled around the shaft of the first base such that when an external force is applied to the net, the shaft of the first base rotates and unfurls at least a portion of the net. The slab of the first base applies a resistance to the shaft of the first base to control the rate at which the net unfurls from the shaft of the first base, where the resistance is based at least in part on the strength of the magnetic field of the first brake.

According to further aspects of the present disclosure, a process for stopping a vehicle is disclosed. The process includes furling a first portion of a net around a rotatable shaft of a first base and furling a second portion of the net around a rotatable shaft of a second base. When a vehicle collides with the net, the speed at which the net unfurls from the first base is magnetically controlled, and the speed at which the net unfurls from the second base is also magnetically controlled.

DETAILED DESCRIPTION

According to various aspects of the present disclosure, a nonlethal barrier is provided, as described below with reference to the accompanying drawings. In this manner, aspects of the present disclosure can be carried out in a variety of different modes and should not be limited to the content of the description of any particular embodiment.

In illustrative applications, a user places the nonlethal barrier in front of an area that needs protection from incoming vehicles (e.g., military installments, stadiums, research facilities, etc.). In alternative applications, the user places the nonlethal barrier in a roadway or other temporary location where it is desirable to stop a vehicle or otherwise prevent a vehicle from passing through. In general, when a vehicle impacts the barrier, the barrier gradually slows down the vehicle, essentially extending the time of impact which reduces the force of impact proportionally, because a vehicle's momentum (mass*velocity) is equal to the force of impact*time of impact:

$$m*v=F*t$$

Thus, the force of an impact is reduced by extending the time of the impact. Correspondingly, the force of an impact is increased by decreasing the time of the impact. Given the typical mass of a vehicle, if the time of impact is near instantaneous, then the force of the impact can be extremely high, even if the vehicle is traveling at a modest velocity at the time of impact. Such a high force may be lethal to the driver or other occupants of the vehicle. However, extending the time of impact may reduce the force of impact enough such that the driver and any other vehicle occupants survive the collision.

Figure 1:
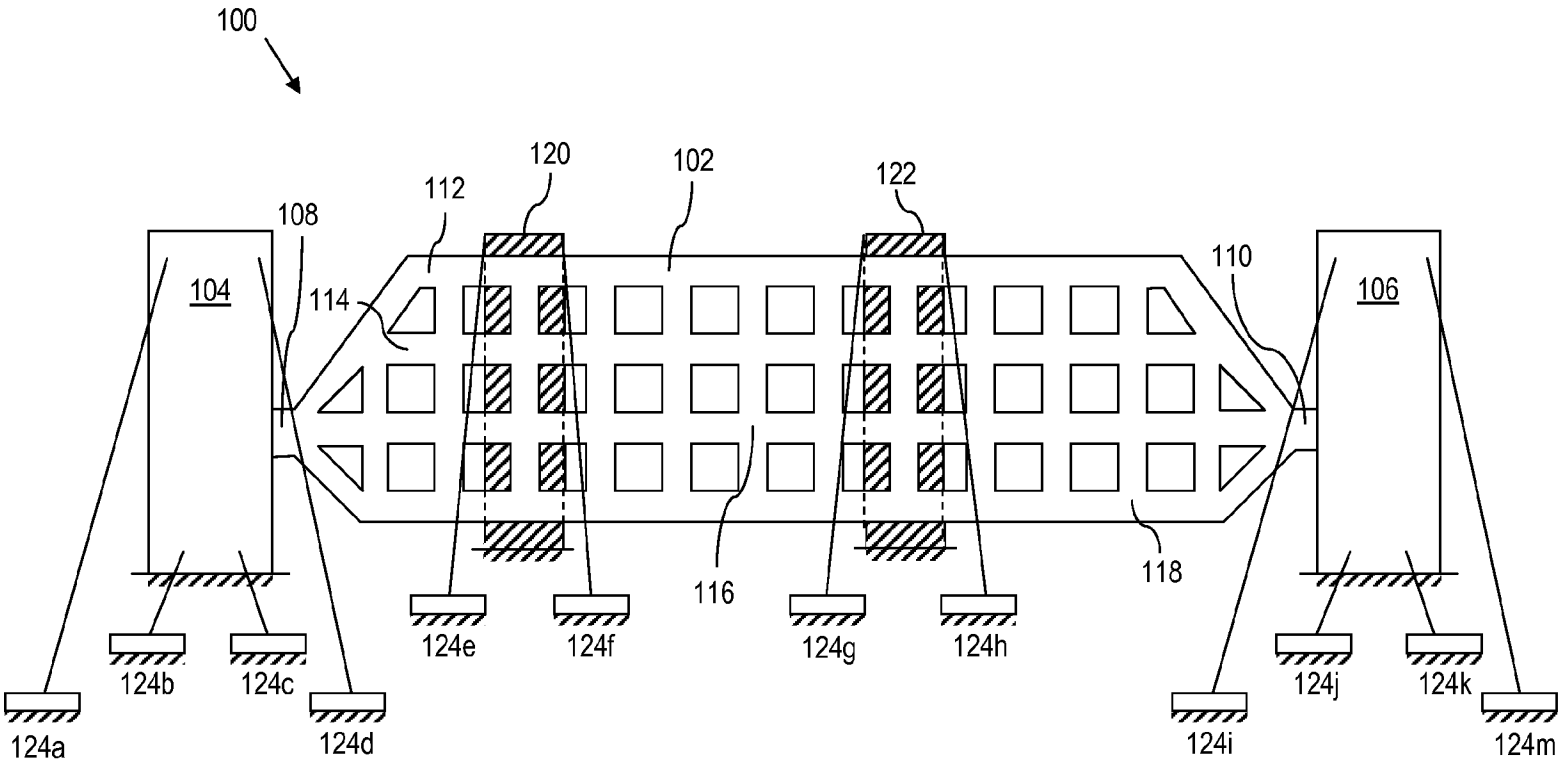
FIG. 1 is a front view of a nonlethal barrier, according to various aspects of the present disclosure.

Turning now to the figures, which are not necessarily drawn to scale, and in particularly to FIG. 1, an exemplary nonlethal barrier 100 with a magnetic braking system is described herein. The exemplary nonlethal barrier system 100 includes a net 102 that is illustrated spanning between a first base 104 and a second base 106.

The net 102 includes a cable 108 (also referred to herein as a net cable) attached to an end of the net 102, so the net can be furled within the first base 104. Also, the net includes another cable 110 on the opposite end so the net 102 can be furled within the second base 106. The net 102 may be shaped with obtuse angles leading to the cables 108, 110 as shown or the net may be shaped in any other suitable manner (e.g., ninety-degree angles, acute angles) leading to the cables 108, 110.

In FIG. 1, the net 102 is illustrated in a position oriented for use as a barricade. That is, the major surface of the net 102 is oriented in a vertical plane. While the exemplary net 102 includes four horizontal members 112, 114, 116, 118, the net 102 may have any number of horizontal members (e.g., depending upon the desired height of the net 102 when the net is oriented as a barricade). Moreover, any number of vertical members may be provided. (e.g., depending upon the desired length of the net 102).

Moreover, the net 102 can be made of any number of suitable materials, the selection of which can depend upon the force requirements of a given application. However, the material preferably has little-to-no elasticity. For example, the net 102 can be made from material used to make a military-grade cargo net (e.g., Kevlar-wrapped tubular webbing). Thus, when a vehicle collides with the nonlethal barrier system 100, the net 102 will not break. Instead, the net 102 will unfurl from the bases 104, 106 and slow down the vehicle over time, as will be described in greater detail herein.

The structure of the base 104, 106 is described in greater detail in reference to FIG. 5, below.

Further, the exemplary nonlethal barrier system 100 can utilize intermediate spools 120, 122. While the intermediate spools 120, 122 are optional, an illustrative implementation includes one intermediate spool 120, 122 for every one-hundred feet (approx. 30.48 meters) of perimeter secured by the nonlethal barrier system 100. Thus, if the system 100 covers a three-hundred foot (approx. 91.44 meters) span, the preferred system 100 would also include two intermediate spools 120, 122. However, other numbers of intermediate spools may be used (e.g., from zero to any positive integer).

The net 102 does not necessarily wrap around the intermediate spools 120, 122. Instead, the net 102 may pass in front of the intermediate spools 120, 122 so as to glide along the intermediate spools 120, 122 when a vehicle collides with the system 100. Further, the intermediate spools 120, 122 may rotate around an axis to lessen drag on the net 102 when a vehicle collides with the nonlethal barrier system 100. Alternatively, the intermediate spools 120, 122 may be static and the net 102 may glide along an outer surface of the intermediate spool 120, 122.

Further, the intermediate spools 120, 122 may include sensors, cameras, or both which are linked to a transmitter, so that information gathered at the intermediate spool 120, 122 can be transmitted to the bases 104, 106, elsewhere, or both.

In the exemplary nonlethal barrier system 100, the bases 104, 106 and intermediate spools 120, 122 are anchored. For instance, the illustrated system 100 is anchored into the ground by several anchors 124*a*-124*m*. When a vehicle collides with the net 102, the anchors 124*a*-124*m* help prevent the bases 104, 106 and intermediate spools 120, 122 from being dragged or otherwise moved by the force of the vehicle applied to the net 102. The bases 104, 106 and intermediate spools 120, 122 may be built directly into the ground itself. Alternatively, the bases 104, 106 may be portable. An illustrative example of the system 100 mounted to a trailer, is depicted in FIG. 2.

Figure 2:
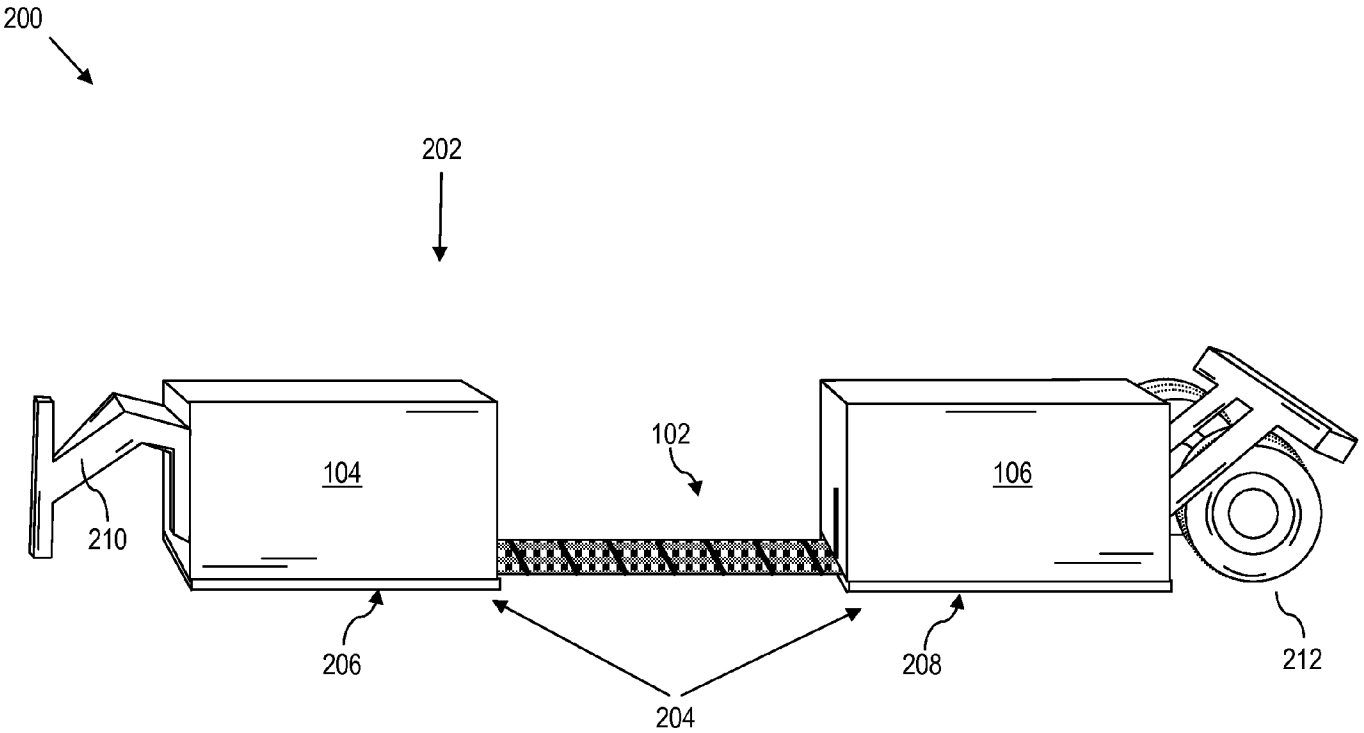
FIG. 2 is a front view of a nonlethal barrier configured for remote deployment, according to various aspects of the present disclosure.

FIG. 2 illustrates an exemplary portable nonlethal barrier system 200 that includes bases 104, 106 mounted on a trailer 202 comprising a platform 204 that is divided into two portions: a hitch portion 206 and a wheeled portion 208. One base 104 is on the hitch portion 206, and the other base 106 is on the wheeled portion 208. The hitch portion 206 includes a hitch 210 to couple the system 200 to a vehicle for transport. The hitch portion 206 may also include other features, such as wheels, casters or other features that assist a user in positioning the hitch portion 206.

The wheeled portion 208 includes wheels 212 for transporting the system 200 when attached to a vehicle. The wheels 212 may be raised relative to the platform 204 when the system 200 is not being trailed behind a vehicle, thus allowing the wheeled portion 208 to rest on the ground. The wheeled portion 208 may also include other features, such as additional wheels, casters or other features that assist a user in positioning the wheeled portion 208 relative to the hitch portion 206 for use as a barrier.

When the exemplary nonlethal barrier system 200 is readied for transport, the hitch portion 206 and the wheeled portion 208 of the platform 204 are coupled together. However, when set up for use as a barrier, the hitch portion 206 and the wheeled portion 208 are separated and positioned. For instance, in an illustrative implementation, the hitch portion 206 is positioned and the wheels 212 of the wheeled portion 208 are adjusted to their raised position. Then, the wheeled portion 208 is moved away from the hitch portion 206 on powered wheels (not shown) to a desired position. Anchors (not shown, but similar to the anchors 124*a*-124*m* of FIG. 1) are run from the bases 104, 106 to the ground to anchor the bases 104, 106, similar to the exemplary system 100 of FIG. 1.

As depicted in FIG. 2, the net 102 has not been raised. When the net 102 is not raised, the net 102 rests in a sectional mat (not shown) that acts as a lattice-work speed bump to protect the net 102 from traffic that is allowed to pass between the bases 104, 106. Alternatively, the net 102 may be stored in a trough. Such a mat, trough, or both may also be included in the exemplary nonlethal barrier system 100 of FIG. 1. When set up to act as a barrier, the net 102 is raised to intercept incoming vehicles.

Power (where necessary) can be supplied to the nonlethal barrier system 100, 200 in any feasible manner. For example, the bases can be hooked up to a power grid; the bases can have one or more batteries; solar panels may be hooked up to one or more bases; a generator may be provided, etc. As will be described in greater detail herein, power is not essential for the system 100, 200 to stop a vehicle because the ultimate braking force is supplied by permanent magnetic mechanisms. However, the availability of power facilitates the use of electronics for control, communication, information gathering, or combinations thereof, as will be described in greater detail herein.

Figure 3:
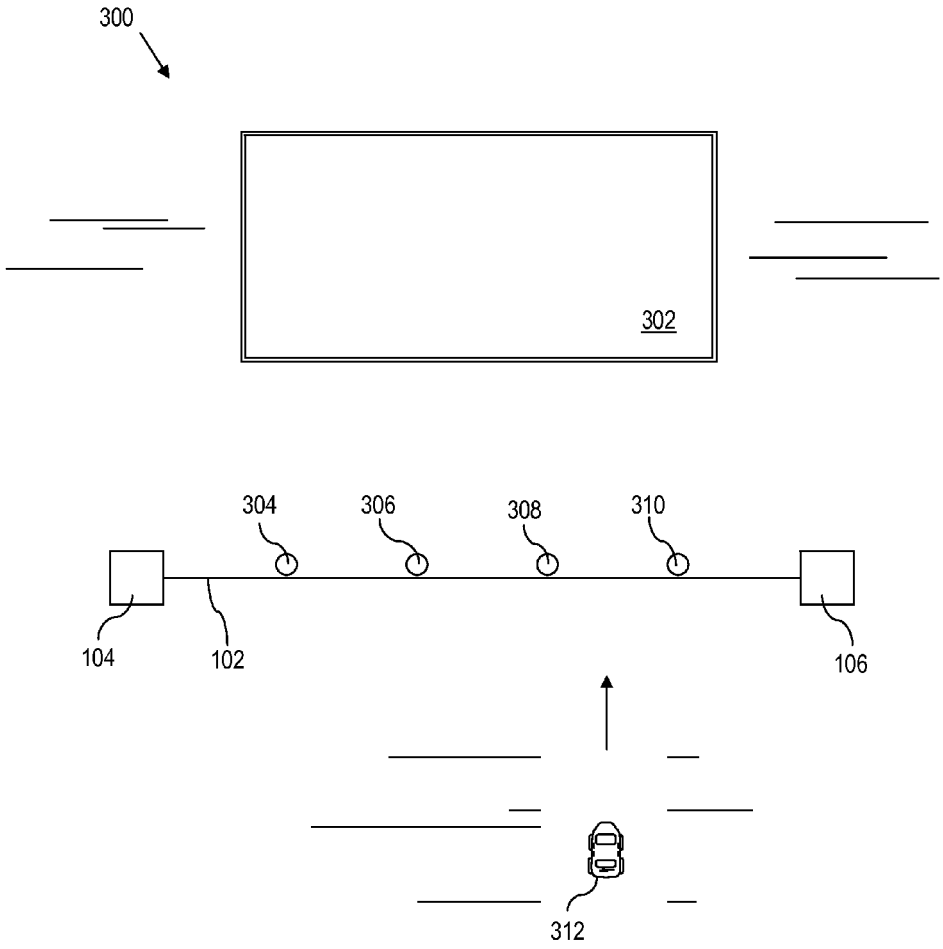
FIG. 3 is a top view of a nonlethal barrier placed in front of a building and a vehicle speeding toward the nonlethal barrier, according to various aspects of the present disclosure.

A process of intercepting a vehicle will now be discussed in reference to FIGS. 3-4. In FIG. 3, an exemplary nonlethal barrier system 300 is erected in front of a building 302. Again, as with the other figures herein, FIG. 3 is not necessarily drawn to scale. The exemplary nonlethal barrier system 300 includes about five hundred feet (approx. 152.4 meters) of net 102 (excluding the furled portions) disposed between two bases 104, 106 and also includes four intermediate spools 304, 306, 308, 310 spaced about one hundred feet (approx. 30.48 meters) apart. In this example, a vehicle 312 is heading toward the nonlethal barrier 300 between the third and fourth intermediate spools 308, 310 in the direction shown by the arrow.

Figure 4:
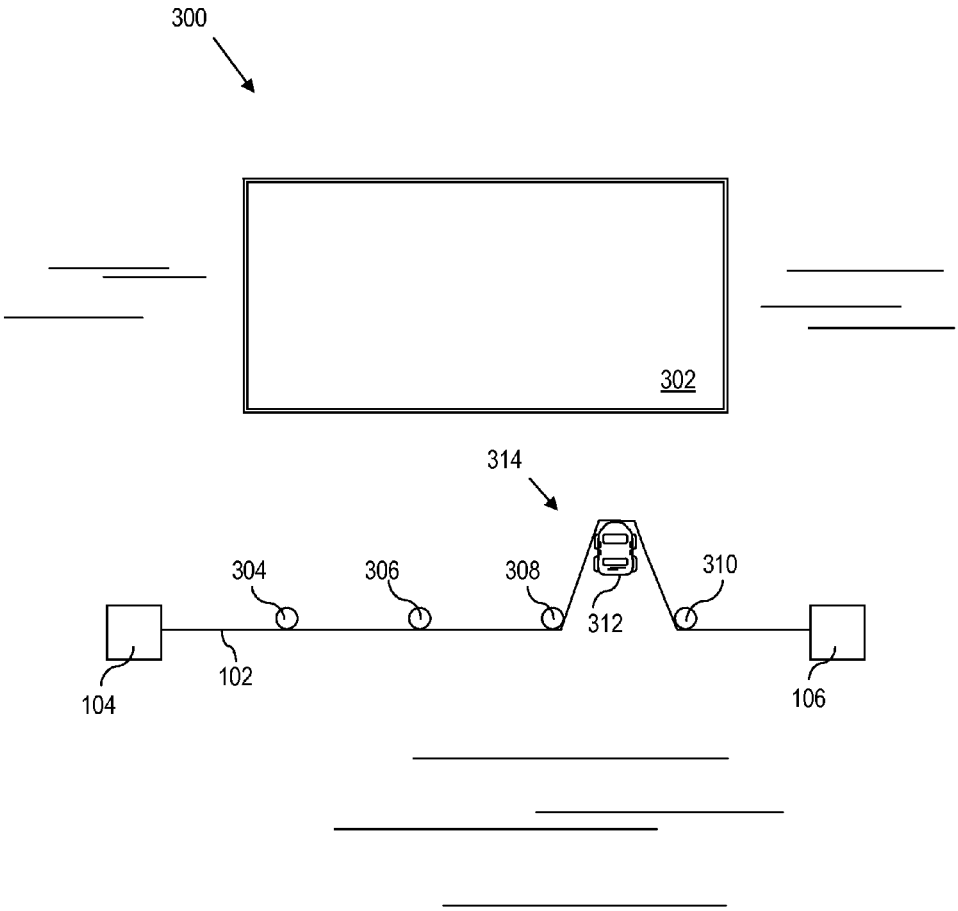
FIG. 4 is a top view of the nonlethal barrier of FIG. 3 after the vehicle has impacted the nonlethal barrier, according to various aspects of the present disclosure.

FIG. 4 illustrates the nonlethal barrier system 300 of FIG. 3 after the vehicle has collided with the nonlethal barrier system 300. When the vehicle 312 first hits the net 102 between the third and fourth intermediate spools 308, 310, the net 102 glides in front of all four intermediate spools 304, 306, 308, 310 and starts to unfurl from the bases 104, 106. At first, the net 102 unfurls at a certain speed, but control electronics in the bases 104, 106 adjust the resistances to that unfurling, thus changing the speed at which the net 102 unfurls. Over time, the vehicle 312 is eventually stopped without using lethal force to stop the vehicle.

The control electronics in the base are described in greater detail in reference to FIG. 6 below. However, the control electronics perform calculations to determine the resistance required for non-lethal stoppage at a specific instant. When performing the calculations, control electronics use trigonometry (inter alia) based on certain angles. One of the angles used in this example, is defined by a portion of the net 314 between the vehicle 312 and the intermediate spool 308 relative to the position that portion 314 of the net 102 was in before the vehicle hit the net 102 (i.e., the position that portion 314 in the plane between the spools 308 and 310). Also, the angle on the opposite side of the vehicle 312, such as that angle defined by a portion of the net between the vehicle 312 and the intermediate spool 310 (similar to the first angle described above) may be used in the calculations.

To determine the angles, the nonlethal barrier system 300 measures the length of net 102 unfurled from the base 104 (inter alia), which should be similar to length of the portion of the net 314 described above. Without the intermediate spools, the calculations for determining the angles would be based on the overall span (e.g., length of the net 102) between the bases 104, 106. Thus, if the length of the net 102 was one thousand feet, then the angle would be different than a net 102 of three hundred feet for the same amount of net 102 unfurled from the base 104, 106.

However, the intermediate spools 304, 306, 308, 310 divide up the net 102 into relatively equal portions. For instance, in the example above, the intermediate spools 304, 306, 308, 310 divide up the net 102 into portions of one hundred feet. As such, all calculations can be based upon an effective span of 100 feet. Thus, the calculations for the angles can be similar no matter what the overall length of the net 102 is, because all of the calculations can be based off of a one hundred foot span. Moreover, the calculations can be the same regardless of where the barricade intercepts the vehicle 312. That is, the calculations are the same regardless of whether the vehicle 312 strikes the net 102 between spool 304 and spool 306, between spool 310 and the base 106, between spool 308 and spool 310, etc. Thus, equations used by the control electronics inside the bases 104, 106 can be similar for all lengths of net 102 if the intermediate spools 304, 306, 308, 310 are used and are equally spaced apart.

With reference to FIGS. 1-4 generally, according to further aspects of the disclosure herein, not only is the time of impact greatly increased through the use of the nonlethal barrier system 100, 200, 300, the force of impact may be varied over time by changing the resistance the base 104, 106 has to unfurling the net 102.

Figure 5:
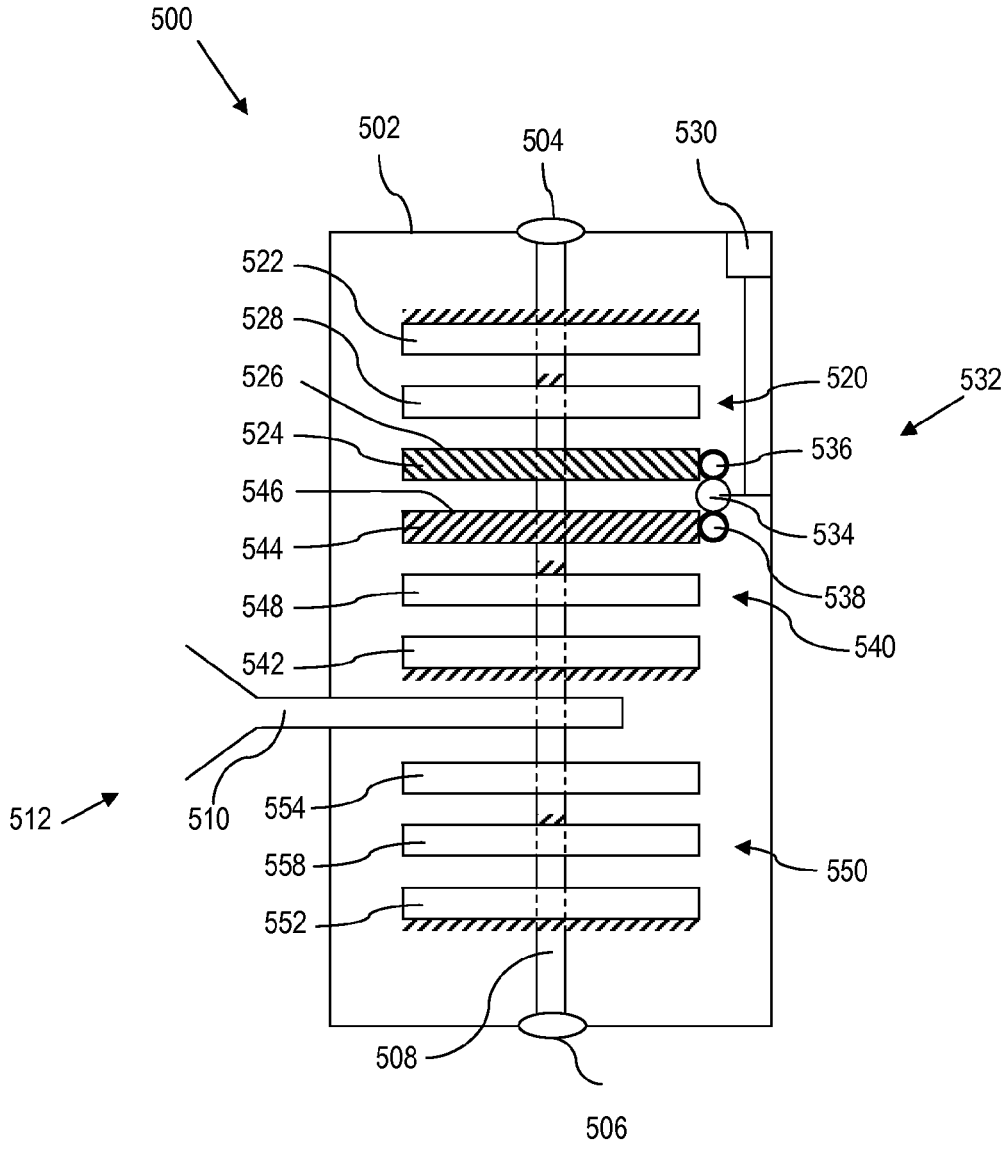
FIG. 5 is a block diagram of a base of the nonlethal barriers of FIGS. 1-4, according to various aspects of the present disclosure.

Referring now to FIG. 5, an exemplary base 500 (104, 106 FIGS. 1-4) that uses magnetism to resist unfurling the net is described. The base 500 includes a frame 502 with a top bearing 504 and a bottom bearing 506. A shaft 508 is disposed between the top bearing 504 and the bottom bearing 506 such that the shaft 508 can rotate freely within the base 500. As such, the shaft 508 is rotatably coupled to the frame 502. A cable 510 (108, 110 in FIG. 1) of a net 512 (102 in FIGS. 1-4) furls around the shaft 508. When an external force is applied to the net 512 (e.g., a vehicle colliding with the net 512), the shaft 508 rotates and some of the net cable 510 unfurls from shaft 508.

However, the base 500 includes a brake 520 that resists the rotation of the shaft 508 when the shaft 508 is unfurling the net cable 510. The brake 520 includes a stationary magnet 522 that is physically coupled to the frame 502. Thus, the stationary magnet 522 does not rotate.

Further, the shaft 508 passes through the stationary magnet 522 such that the stationary magnet 522 does not physically resist rotation of the shaft 508. As such, the stationary magnet 522 may be one disk-shaped magnet with a hole through which the shaft 508 passes. Moreover, the stationary magnet 522 may be several individual magnets and the shaft 508 passes between the individual magnets. In preferred embodiments, the stationary magnet 522 is a disk-shaped magnet. Further, the stationary magnet 522 may be a permanent magnet or an electromagnet.

The brake 520 further includes an adjustable magnet 524 that is spaced away from the stationary magnet 522 and creates a magnetic field with the stationary magnet 522. As with the stationary magnet 522, the shaft 508 goes through the adjustable magnet 524 (e.g., though a hole of a disk-shaped magnet, between individual magnets, both through a hole and between individual magnets, etc.) such that the adjustable magnet 524 does not physically resist rotation of the shaft 508. In preferred embodiments, the adjustable magnet 524 is a disk-shaped magnet. The adjustable magnet 524 may be a permanent magnet or an electromagnet. The outer edge of the adjustable magnet 524 includes a series of grooves 526 that allow for rotating the adjustable magnet 524 as will be described below.

Disposed in the magnetic field created between the stationary magnet 522 and the adjustable magnet 524 is a slab 528 that is physically coupled to the shaft 508. Thus, a force that resists rotation of the slab 528 also resists rotation of the shaft 508. The slab may be made of any electrically conductive material; however, a nonferrous metal (e.g., nickel, copper, aluminum, etc.) or alloy is preferred.

When the slab 528 moves through the magnetic field (i.e., when the shaft 508 rotates to unfurl the net cable 510), the magnetic field creates eddy currents on the slab 528. These eddy currents generate an opposing magnetic field (via Lenz's law), which resists the rotation of the slab 528 and thus resists the rotation of the shaft 508. Thus, the rotation of the shaft 508 is controlled using magnets instead of friction like a friction-based brake. That is, the brake 520 itself provides "non-contact" braking force. Moreover, because there is no contact between the components of the brake, the brake structure that will not wear out and does not require electricity to operate.

The strength of the magnetic field between the stationary magnet 522 and the adjustable magnet 524 and speed of rotation of the shaft 508 influence the strength of the eddy currents and consequently the strength of the resistive magnetic field generated by the eddy currents. The stationary magnet 522 and adjustable magnet 524 are magnetically coupled such that a rotation on the adjustable magnet 524 will change the strength of the magnetic field. Thus, if control electronics 530 (described in greater detail below in reference to FIG. 6) determine that the force of impact is too great, then the control electronics 530 will rotate the adjustable magnet 524 to lessen the strength of the magnetic field, which lessens the resistance to rotation of the shaft 508 as described above, which lessens the force of impact on the vehicle. By controlling the amount of offset of the adjustable magnet 524 based on deceleration of the vehicle (which can be calculated based upon a computed angle of the net 102 and the length of net 102 unfurled from the base 104 as described above with reference to FIGS. 3-4) the g-force applied to the vehicle occupants can be controlled dynamically for any mass of vehicle to such that the force of the impact falls below a lethal level. Moreover, control electronics 530 can be used and tailored to optimize a braking profile for all vehicles. Moreover, the control electronics 530 allow the system to rapidly adapt for varying loads to specific vehicle mass conditions without operator intervention. Moreover, the control electronics can account for a second impact that may occur before the non lethal barrier system is reset from a first impact by altering the impact characteristics based on the dynamics of the first vehicle entanglement.

To rotate the adjustable magnet 524, the control electronics 530 control a motor coupled to a worm drive 532, which includes a worm gear 534 and a worm 536. The worm 536 of the worm drive 532 is coupled to the grooves 526 of the adjustable magnet 524, so a rotation of the worm gear 534 will drive the worm 536, which rotates the adjustable magnet 524 to control the strength of the magnetic field.

In some embodiments, a spring box may be used as a counterweight to rotate the magnets back and forth. As such, a system with the spring box may use a motor with a relatively small power rating.

More than one magnetic brake 520 may be employed in a single base 500. For example, the exemplary base 500 of FIG. 5 includes three brakes 520, 540, 550. The first brake 520 operates as described above. A second brake 540 also includes a stationary magnet 542 similar to the stationary magnet 522 of the first brake 520. Also, the second brake 540 includes an adjustable magnet 544 with grooves 546 and a slab 548; all of which operate similarly to their respective components in the first brake 520. Further, the exemplary base 500 includes another worm 538 that runs off of the worm gear 534 to adjust the adjustable magnet 544 of the second brake 540. In preferred embodiments, the magnetic polarity of the adjustable magnet 544 of the second brake 540 is opposite of the magnet polarity of the adjustable magnet 524 of the first brake 520. Thus, in certain illustrative implementations, one worm gear 534 may be used to simultaneously control and adjust two brakes, e.g., brake 520 and brake 540.

In order for the magnetic fields of the first brake 520 and the second brake 540 to not interfere with each other, the adjustable magnet 544 of the second brake 540 should not be more than about nineteen degrees (approx. 0.33 radians) out of phase with the adjustable magnet 524 of the first brake 520. For example, on a base 500 with six-foot (approx. 1.83 meters) diameter brakes, the adjustable magnets 524, 544 should not be more than six inches (15.24 centimeters) out of phase on their circumferences.

The worm drive 530 with the two worms 536, 538 described above help ensure that the adjustable magnets 524, 544 remain generally in phase with each other. Also, one of the adjustable magnets 524, 544 could include a physical stopper that does not allow the adjustable magnets to physically get out of phase. Further, the magnetic fields of the first and second brakes 520, 540 may be generally equal to each other, even when adjusted.

As mentioned above, the exemplary base 500 of FIG. 5 includes not only the first and second brakes 520, 540 but also a third brake 550. As depicted, the third brake 550 includes two stationary magnets 552, 554 physically coupled to the frame 502 and a slab 558 coupled to the shaft 508. The third brake 550 works similarly to the first and second brakes 520, 540, except that the third brake has two stationary magnets 552, 554 to create the magnetic field instead of one stationary magnet and one adjustable magnet. As such, the third brake 550 cannot change the strength of its magnetic field (i.e., the strength of the magnetic field of the third brake is constant).

Other base formations include anywhere from one magnetic brake to many magnetic brakes. Also, the magnetic brakes in the base may have adjustable magnetic fields or constant magnetic fields. For example, the exemplary base 500 has two adjustable brakes and one constant brake. However, other bases may have only one adjustable brake; one adjustable brake and a constant brake; two adjustable brakes; one adjustable brake and two constant brakes; etc.

With six-foot (approx. 1.83 meters) diameter magnets in the exemplary base 500, the nonlethal barrier system can safely stop a six-ton vehicle travelling at sixty miles per hour. Also, much lighter vehicles may also be safely stopped because the brakes adapt to the momentum of the colliding vehicle.

Figure 6:
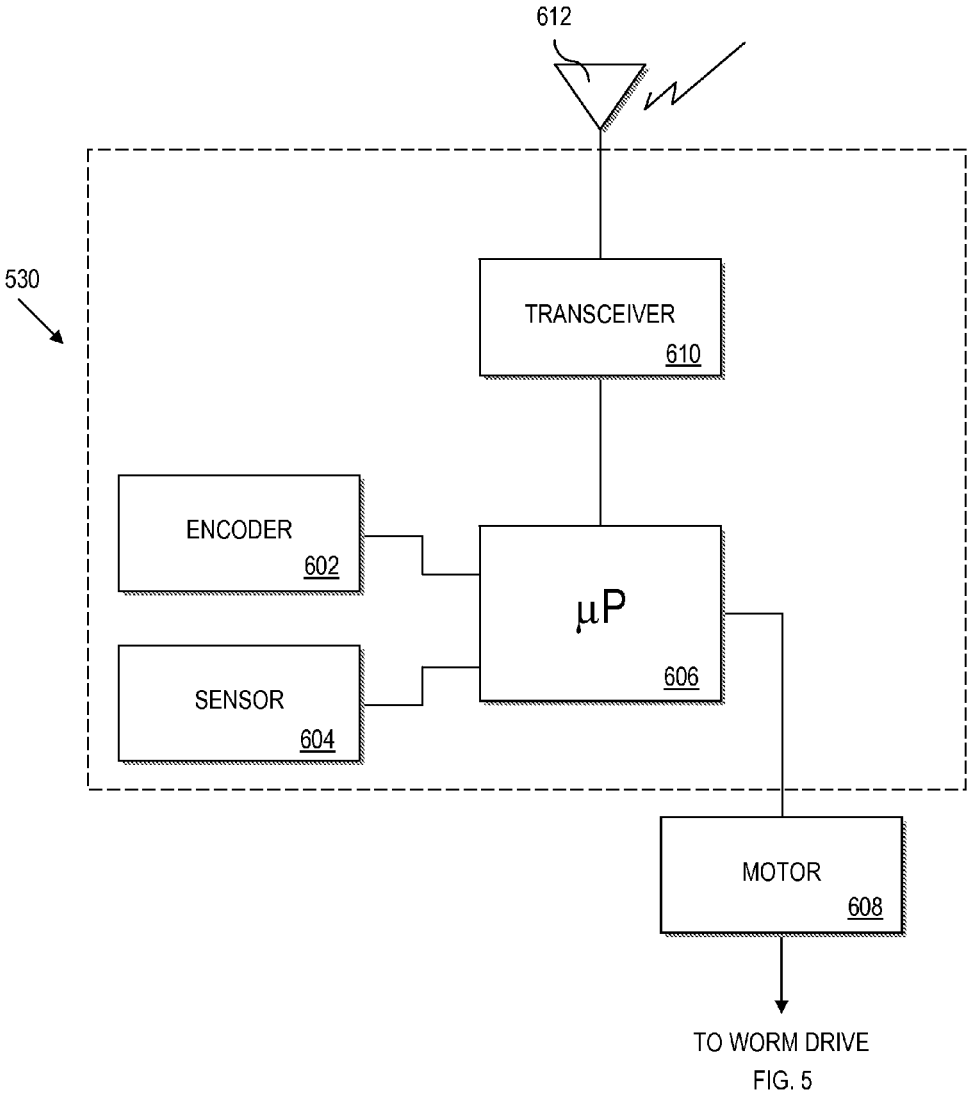
FIG. 6 is a front-view schematic of control electronics in the base of FIG. 5, according to various aspects of the present disclosure.

Turning now to FIG. 6, exemplary control electronics 530 include an encoder 602 and a sensor 604 that both feed a processor 606. The encoder 602 determines the angular position of the shaft (508, FIG. 5). Thus, as the shaft rotates, the encoder will produce different values to indicate the angular position of the shaft. The processor 606 can use this angular position to determine rotations of the shaft, which the processor 606 uses to determine the length of net cable (510, FIG. 5) that has been unfurled from the base. Further, the processor 606 can use the angular position to determine the speed at which the net is unfurling at a given instant. Using that length, speed, or both in calculations, the processor can then control the motor 608 of the base to operate the worm drive to adjust the adjustable magnet. As mentioned above, adjusting the adjustable magnet changes the strength of the magnetic field, which changes the resistance to the rotating of the shaft as the net unfurls.

Also, the encoder 602 (or another encoder) can be part of a wheel (not shown) whose circumference is coupled to an outer edge of the furled net, which is coupled to the shaft. As the net unfurls, the wheel rotates, and based on the fixed circumference of the wheel and the angular rotation of the wheel, the processor 606 can calculate the length of net unfurled. This wheel does not need to be a load bearing wheel, but should remain in contact with the net while the net unfurls. Thus, the encoder may be coupled directly or indirectly to the shaft, or the system may include multiple encoders.

Alternatively, or in addition, the processor 606 may use the sensor 604 to determine the length of net unfurled. The sensor 604 senses the radius of the net furled around the shaft. As the net unfurls, the radius of the net furled around the shaft will decrease. Thus, the processor 606 can use the radius of the net furled around the shaft to determine the length of net that has unfurled from the shaft. Using that length in calculations, the processor 606 can then control the motor 608 of the base to operate the worm drive to adjust the adjustable magnet, which changes the strength of the magnetic field to change the resistance to the rotating of the shaft as the net unfurls. The sensor 606 may be any type of sensor capable of sensing the radius of furled net cable (e.g., e-field sensor, optical sensor, etc.).

Further, the exemplary control electronics 530 may include a transceiver (wired or wireless) that can transmit information to other transceivers (e.g., solar powered transceivers on the spools), receive information from other transceivers, or both. In order to transmit and receive data, the transceiver 610 is coupled to an antenna 612, which may be separate from the control electronics 530 (as shown) or part of the control electronics 530.

Information that may be transmitted/received may include information based on the angular position of the shaft, the radius of the net furled around the shaft, or both. The information can then be sent to the other base in the system, to other bases in other nearby nonlethal barrier systems, or both.

When a base receives such information, that base (e.g., 104, FIG. 1) may then use that information in calculating how the adjustable magnet should be adjusted to modify the resistance to rotation applied to the shaft. Thus, the processor 606 controls the angular position of the adjustable magnet based in part on information received from the other base (e.g., 106, FIG. 1) in the nonlethal barrier system.

As mentioned above, the control electronics 530 may include a sensor 604, an encoder 606, a transceiver 610, or a combination thereof in addition to a processor 606. The processor 606 can then use outputs from the sensor 604, the encoder 606, the transceiver 610, or the combination thereof to determine how to adjust the adjustable magnet(s) to change the resistance of the shaft to rotation.

Figure 7:
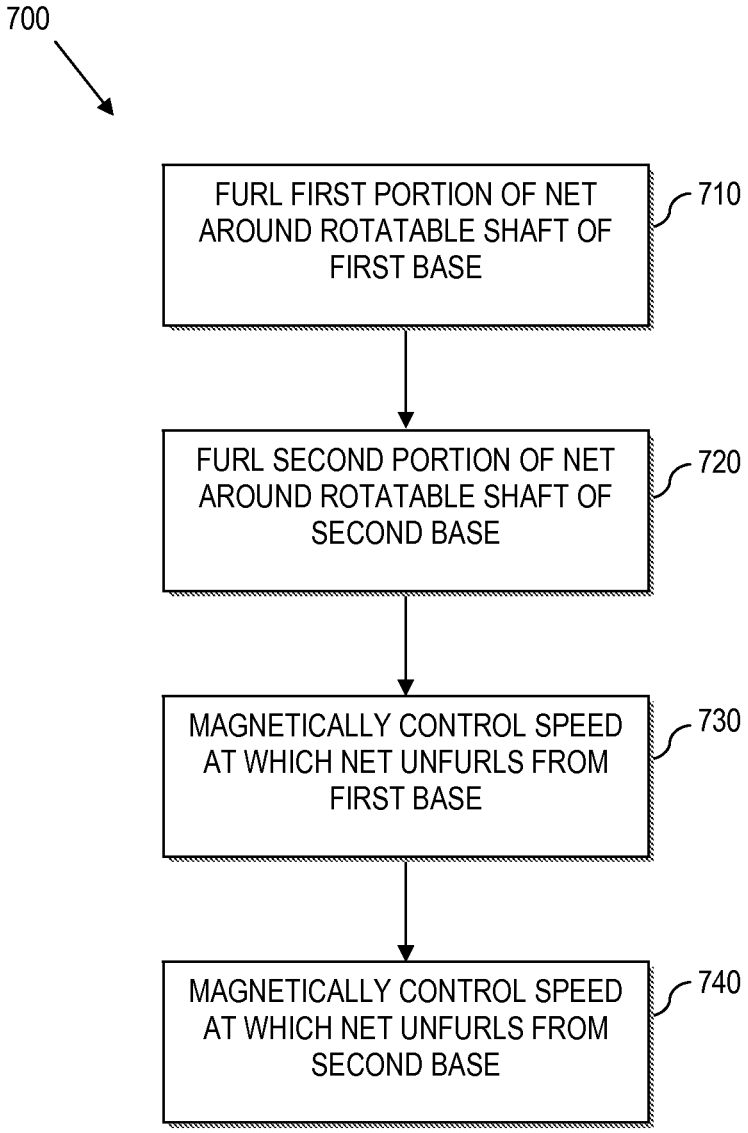
FIG. 7 is a flow chart illustrating a method of stopping a vehicle, according to various aspects of the present disclosure.

Referring now to FIG. 7, a general process 700 for stopping a vehicle is disclosed. At 710, a first portion of a net is furled around a rotatable shaft of a first base. The first portion of the net may be a net cable, netting, or both. At 720, a second portion of a net is furled around a rotatable shaft of a second base. As with the first portion, the second portion of the net may be a net cable, netting, or both.

When a vehicle collides with the net, at 730, the speed at which the net unfurls from the first base is magnetically controlled. At 740, the speed at which the net unfurls from the second base is also magnetically controlled. The magnetic speed-controlling may be performed as described above in reference to FIGS. 1-6.

The flowchart and block diagrams in the figures illustrate the architecture, functionality, and operation of possible implementations of systems or methods according to various aspects of the present disclosure. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Aspects of the disclosure were chosen and described in order to best explain the principles of the disclosure and the practical application, and to enable others of ordinary skill in the art to understand the disclosure for various embodiments with various modifications as are suited to the particular use contemplated.

What is claimed is:

1. A nonlethal barrier system comprising:
- a first base comprising:
  - a frame;
  - a shaft rotatably coupled to the frame; and
  - a first brake comprising:
    - a stationary magnet physically coupled to the frame, wherein the shaft passes through the stationary magnet;
    - an adjustable magnet magnetically coupled to the stationary magnet to create a magnetic field between the stationary magnet and the adjustable magnet such that the strength of the magnetic field is alterable by rotating the adjustable magnet; and
    - a slab physically coupled to the shaft, wherein the slab is disposed in the magnetic field between the stationary magnet and the adjustable magnet; and
- a net furled around the shaft of the first base such that when an external force is applied to the net, the shaft of the first base rotates and unfurls at least a portion of the net; wherein:
- the slab of the first base applies a resistance to the shaft of the first base to control the rate at which the net unfurls from the shaft of the first base; and
- the resistance is based at least in part on the strength of the magnetic field of the first brake.

2. The nonlethal barrier system of claim 1, wherein the first base further comprises:
- an encoder coupled to the shaft, wherein the encoder determines an angular position of the shaft;
- a sensor that senses a radius of the net furled around the shaft; and
- a processor coupled to the encoder and the sensor, wherein the processor controls an angular position of the adjustable magnet based at least in part on the angular position of the shaft and the radius of the net furled around the shaft.

3. The nonlethal barrier system of claim 2, wherein the processor controls the angular position of the adjustable magnet of the first brake using a worm drive comprising:
- a worm gear coupled to a motor; and
- a worm coupled between the worm gear and the adjustable magnet of the first brake.

4. The nonlethal barrier system of claim 1 further comprising:
- a second base positionable spaced apart from the first base, the second base comprising:
  - a frame;
  - a shaft rotatably coupled to the frame; and
  - a first brake comprising:
    - a stationary magnet physically coupled to the frame, wherein the shaft passes through the stationary magnet;
    - an adjustable magnet magnetically coupled to the stationary magnet to create a magnetic field between the stationary magnet and the adjustable magnet such that the strength of the magnetic field is alterable by rotating the adjustable magnet; and
    - a slab physically coupled to the shaft, wherein the slab is disposed in the magnetic field between the stationary magnet and the adjustable magnet;
- wherein the net is further furled around the shaft of the second base so as to span between the shaft of the first base and the shaft of the second base, such that when an external force is applied to the net, the shaft of the second base rotates and unfurls at least a portion of the net;

wherein:

the slab of the second base applies a resistance to the shaft of the second base to control the rate at which the net unfurls from the shaft of the second base, wherein the resistance is based at least in part on the strength of the magnetic field of the first brake of the second base.

5. The nonlethal barrier system of claim 4, wherein:

the first base further comprises:

an encoder coupled to the shaft, wherein the encoder determines an angular position of the shaft;

a sensor that senses a radius of the net furled around the shaft;

a processor coupled to the encoder and the sensor, wherein the processor controls an angular position of the adjustable magnet based at least in part on the angular position of the shaft and the radius of the net furled around the shaft; and a transceiver coupled to the processor;

wherein the first base transmits first-base information based on the angular position of the shaft and the radius of the net furled around the shaft to the second base via the transceiver; and the second base further comprises:

an encoder coupled to the shaft, wherein the encoder determines an angular position of the shaft;

a sensor that senses a radius of the net furled around the shaft;

a transceiver coupled to the processor, wherein the transceiver receives the first-base information from the first base; and a processor coupled to the encoder and the sensor, wherein the processor controls an angular position of the adjustable magnet based at least in part on the angular position of the shaft, the radius of the net furled around the shaft, and the first-base information.

6. The nonlethal barrier system of claim 5, wherein the transceiver of the first base is a wireless transceiver, and the transceiver of the second base is a wireless transceiver.

7. The nonlethal barrier system of claim 4 further comprising an intermediate spool disposed between the first base and the second base such that when an external force is applied to the net, at least a portion of the net substantially remains in a same plane as before the external force is applied to the net.

8. The nonlethal barrier system of claim 7, wherein the intermediate spool further comprises:

a wireless transmitter; and a select one of: a sensor and a camera coupled to the transmitter.

9. The nonlethal barrier system of claim 4, wherein the first base and the second base are mounted to a platform with wheels for transport.

10. The nonlethal barrier system of claim 1, wherein the net further comprises a net cable configured such that the net furls around the shaft of the first base via the net cable.

11. The nonlethal barrier system of claim 1, wherein the first base further comprises a second brake comprising:

a stationary magnet physically coupled to the frame, wherein the shaft passes through the stationary magnet;

an adjustable magnet magnetically coupled to the stationary magnet to create a magnetic field between the stationary magnet and the adjustable magnet such that the strength of the magnetic field is alterable by rotating the adjustable magnet; and a slab physically coupled to the shaft, wherein the slab is disposed in the magnetic field between the stationary magnet and the adjustable magnet.

12. The nonlethal barrier system of claim 11, wherein the second brake is arranged such that the adjustable magnet of the second brake is magnetically opposite of the adjustable magnet of the first brake.

13. The nonlethal barrier system of claim 12, wherein the first base includes an obstruction that ensures that the adjustable magnet of the first brake remains no more than around nineteen degrees (approx. 0.33 radians) out of phase with the adjustable magnet of the second brake.

14. The nonlethal barrier system of claim 11, wherein the resistance of the second brake is kept generally equal to the resistance of the first brake.

15. The nonlethal barrier system of claim 14, wherein a processor controls the angular position of the adjustable magnet of the first brake and the angular position of the adjustable magnet of the second brake using a worm drive comprising:

a worm gear coupled to a motor;

a first worm coupled between the worm gear and the adjustable magnet of the first brake; and a second worm coupled between the worm gear and the adjustable magnet of the second brake.

16. The nonlethal barrier system of claim 11 further comprising a third brake comprising:

a first magnet physically coupled to the frame, wherein the shaft passes through the first magnet;

a second magnet magnetically coupled to the first magnet to create a magnetic field between the first magnet and the second magnet; and a slab physically coupled to the shaft, wherein the slab is disposed in the magnetic field between the first magnet and the second magnet.

17. The nonlethal barrier system of claim 1 further comprising a second brake comprising:

a first magnet physically coupled to the frame, wherein the shaft passes through the first magnet;

a second magnet magnetically coupled to the first magnet to create a magnetic field between the first magnet and the second magnet; and a slab physically coupled to the shaft, wherein the slab is disposed in the magnetic field between the first magnet and the second magnet.

* * * * *